US009205695B2

(12) United States Patent
Budge et al.

(10) Patent No.: US 9,205,695 B2
(45) Date of Patent: Dec. 8, 2015

(54) SCRAPBOOK KIT AND METHOD FOR CREATING A MULTI-LAYERED VISUAL IMAGE

(76) Inventors: Susan Elise Budge, Cedar City, UT (US); Debra Budge, Cedar City, UT (US); Shilon Jorgensen, Fernley, NV (US)

( * ) Notice: Subject to any disclaimer, the term of this patent is extended or adjusted under 35 U.S.C. 154(b) by 0 days.

(21) Appl. No.: 13/088,073

(22) Filed: Apr. 15, 2011

(65) Prior Publication Data

US 2015/0191035 A1 Jul. 9, 2015

(51) Int. Cl.

| | |
|---|---|
| ***B42B 7/00*** | (2006.01) |
| ***A45C 11/36*** | (2006.01) |
| ***B42D 1/08*** | (2006.01) |
| ***B42F 7/06*** | (2006.01) |

(52) U.S. Cl.
CPC . *B42B 7/00* (2013.01); *A45C 11/36* (2013.01); *B42D 1/08* (2013.01); *B42F 7/06* (2013.01)

(58) Field of Classification Search
CPC ..... B42D 1/08; A45C 11/36; B42F 7/06
USPC ..... 281/22; 206/1.7; 312/231; D19/113
See application file for complete search history.

(56) References Cited

U.S. PATENT DOCUMENTS

| | | | | |
|---|---|---|---|---|
| 2,487,673 | A | 11/1949 | Roper | |
| 6,112,425 | A | 9/2000 | Nelson et al. | |
| 6,418,625 | B1 | 7/2002 | Baum | |
| 6,959,806 | B2 * | 11/2005 | Barker | 206/6.1 |
| 2003/0160824 | A1 | 8/2003 | Szumla | |
| 2005/0188575 | A1 | 9/2005 | Hall et al. | |
| 2005/0188799 | A1 | 9/2005 | Kocienski | |
| 2005/0253371 | A1 | 11/2005 | Connolly | |
| 2006/0192376 | A1 * | 8/2006 | Langford | 281/15.1 |
| 2007/0049477 | A1 | 3/2007 | Hester et al. | |
| 2007/0193049 | A1 | 8/2007 | Vetromila | |
| 2007/0251853 | A1 | 11/2007 | Anderson et al. | |
| 2008/0120535 | A1 | 5/2008 | Lynton | |

OTHER PUBLICATIONS

SB Tip #1 (Aug. 2009) https://web.archive.org/web/20090802193501/http://www.scrapbook.com/tips/doc/9025/248.html.*

SB Tip #2 (Apr. 2008) https://web.archive.org/web/20080428030558/http://www.scrapbook.com/tips/doc/26521/37.html.*

* cited by examiner

*Primary Examiner* — Kyle Grabowski
(74) *Attorney, Agent, or Firm* — Schmeiser, Olsen & Watts LLP

(57) ABSTRACT

A scrap book page design kit formed to contain elements used to enable a method of creating a desired visual effect on a scrapbook page. This is done by providing a user with a selection of themes of associated templates. The kit having a base surface designed to place at least two scrap book working pages thereon, which are used to place the templates thereon and thus create the desired visual effect. The kit also having a top flap, coupled to a top edge of the base surface, having at least three pockets thereon for placing the boarder, accessory and picture templates separately therein. Additionally, the kit has a right flap, coupled to a right edge of the base surface, having at least one pocket for placing a sheet of working paper therein, and a left flap, coupled to a left edge of the base surface, having a least one pocket for holding pictures selected to be placed on the scrap book working page.

1 Claim, 15 Drawing Sheets

SCRAPBOOK KIT AND METHOD FOR CREATING A MULTI-LAYERED VISUAL IMAGE

CROSS-REFERENCE TO RELATED APPLICATIONS

This invention has no claims of priority, under 35 U.S.C. §120, to any United States Provisional Patent, which would be incorporated by reference herein. This invention also claims no priority, under 35 U.S.C. §119, to any foreign Patent Application, which would be incorporated by reference herein. This application is not a Divisional application of, under 35 U.S.C. §121, and claims no priority under 35 U.S.C. §121, to a United States Non-Provisional application.

BACKGROUND OF THE INVENTION

1. Field of the Invention

The present invention relates to art supplies, specifically to templates for visually planning out and designing layouts for scrapbook pages, including a scrapbook kit and method for creating a multi-layers visual image.

2. Description of the Related Art

In the related art, it has been known to use templates for designing layouts for scrapbook pages. Additionally, template stencils are well-known in the art as guides for artists who seek to draw or cut pre-determined shapes. A template usually comprises a semi-rigid piece of plastic, having a small thickness. The face of the template can have a variety of different voids or cut-outs. The interior cut-outs are given their shape by the interior edges of the template, which guide the writing instrument of a user along the path proscribed by the edge of the template. The template is placed upon a sheet desired to be drawn upon (design page). The user draws along the interior edges of the template and a drawn line is created on the design page coinciding with the shape or pattern that the interior edge of the template possessed.

Scrapbook kits facilitate the creation and development of a scrapbook. Typically, a scrapbook kit will include a variety of prepackaged material designed to be inserted into a scrapbook, where the prepackaged materials relate to a certain event or subject. For example, some existing scrapbook kits are intended to memorialize holidays, such as Christmas, and mint include stickers, cardboard cut outs, letter sized paper with printed designs, each displaying subject matter relevant to the holiday.

Additionally, photographs can be placed in albums of varying styles, where they are mounted for viewing on one or more pages in a format resembling a book. Such book formats are also refereed to a photo albums or scrapbooks that permit the convenient storage of photographs.

While book formats are known, challenges still exist in that many formats are simply placed into the photo album without much variation. Accordingly, the presentation often remains repetitive and boring. Thus, while techniques currently exist that are used to assist persons mounting photographs, there remains a need for advances in the art of creating new refreshing and divergent methods of creating the overall look of the page layout. Accordingly, it would be an improvement in the art to augment or even replace current techniques with newer, easier, quicker techniques.

Some improvements have been made in the field. Examples of references related to the present invention, but not teaching alone or in combination the present invention are described below, and the supported teachings of each reference are incorporated by reference herein:

U.S. Pat. No. 2,487,673: GEOMETRICAL SKETCHING TEMPLATE, issued Nov. 8, 1949 to ROPER, discloses geometrical sketching template and consists in forming a template preferably of Celluloid or transparent plastic material and forming or cutting the edges thereof into pre-determined configurations and further cutting or forming in the body proper thereof, a plurality of pre-determined geometrical figures.

U.S. Pat. No. 6,112,425: BORDER, CORNER AND CUT-OUT TEMPLATE, issued Sep. 5, 2000 to NELSON, discloses a template for guiding a writing or cutting implement which comprises a plurality of patterns along its outer edges. In one embodiment, the template has four outer edges, each comprising a different pattern. The template further comprises a plurality of voids or cut-outs defined by shape-defining edges, disposed within the face of the template. The template further comprises a plurality of corner hole edges, center hole edges and rectangular marker hole edges for facilitating the positioning of the template on to a transfer sheet. Another embodiment of the template includes a layering system, designed to enable stenciling of a unique layered pattern. The layering system comprises a plurality of sets of voids or cut-outs defined by shape-defining edges, each set having a plurality of marker holes associated therewith. Each set of shapes is stenciled after being successively aligned with a marked drawing spot, and a layered effect is created by stenciling only that portion of each shape from a set which does not overlap any shapes from a previously stenciled set.

U.S. Pat. No. 6,418,625: PAGE MAKER TEMPLATE, issued Jul. 16, 2002 to NELSON, discloses a template for guiding an implement on a design page, such as a scrapbook page. The template has a first plurality of interior edges defining shapes and a second plurality of interior edges defining borders around the shapes. The first and second pluralities of interior edges are configured on the template so as to provide a layout that is transferable to the design page. According to one embodiment, the interior edges are configured on the template so as to provide a layout which is transferable to the design page without having to reposition the template. The layout is employed, according to one embodiment, to arrange display objects, such as photographic or hand-drawn pictures, on the design page. In one embodiment, the template has a third plurality of interior edges defining slots, which are employed to guide a user in writing captions corresponding to the displayed objects.

U.S. Patent Application Publication No. US2003/0160824: ORGANIZING AND PRODUCING A DISPLAY OF IMAGES, LABELS AND CUSTOM ARTWORK ON A RECEIVER by SZUMLA, discloses an electronic album creation system that includes: an album construction window having an open, blank electronic canvas defining an open raster space such that the raster space receives a wide variety of graphics, text, and photos in a random fashion; a portfolio window of selected displayed images; digital toolbars containing icons that represent artistic and operational functions; drag and drop selection means for placing unfinished templates within the electronic canvas; and personalized creative art tools that define a user's selective input for artistic composition, color, and placement in the electronic album.

U.S. Patent Application Publication No. US2005/0188575: MULTI-LEAF PAGE FOR MOUNTING SUBSTRATE ARTICLES, by HALL, discloses a multi-leaf page for mounting substrate articles comprises an imperforate base leaf, a top leaf, and an intermediate leaf positioned between the top leaf and the base leaf. The base leaf, the intermediate leaf, and the top leaf are arranged in overlying parallel relation and are joined together at edges thereof such that the leaves can be pivotally separated from one another to enable the substrate articles to be mounted therebetween. The top leaf and the intermediate leaf include a pair of aligned windows for enabling a substrate article to be mounted to the base leaf and exposed through the aligned windows. The top leaf, the intermediate leaf, and the base leaf have imperforate regions overlying one another where no windows are formed in any of the leafs.

U.S. Patent Application Publication No. US2005/0253371: SCRAPBOOKING SUPPLIES SYSTEM, by CONNOLLY, discloses a scrapbooking supplies system including a backing panel including at least two main panel sections that are foldable relative to each other, and a plurality of different types of scrapbooking components coupled to the backing panel. Each of the scrapbooking components of the plurality of different types of scrapbooking components can be manually separated from the backing panel for use separate and apart from the backing panel.

U.S. Patent Application Publication No. US 2005/0188799: LAYOUT DESIGN TOOL AND METHOD OF USING, by HALL, discloses a layout design tool and method of using is disclosed. The layout design tool includes a substantially flat base portion formed of a magnetic material, and a plurality of shaped portions, formed of a magnetic material, wherein the plurality of shaped portions are detachably attached to the substantially flat base portion by magnetism. The method of using a layout design tool for laying out a design includes the steps of attaching one of a plurality of shaped portions to a substantially flat base portion, and moving the one of plurality of shaped portions as needed on the substantially flat base portion.

U.S. Patent Application Publication No. US2007/0193049: CRAFT BOARD ASSEMBLY AND METHOD OF USE, by VETROMILA, discloses a craft board assembly is described. Embodiments of the craft board comprise a base having a self-healing mat coupled thereto. A square frame rule is provided that defines an interior work area having predetermined dimensions. A piece of paper, such as a scrapbook page, that is the same size as work area dimensions can be received in the work area and is held securely in place by the interior edges of the square frame rule's sides thereby preventing lateral movement of the paper while it is being worked upon. A sliding ruler is also provided that spans two sides of the frame rule permitting a user to quickly and easily measure and layout a scrapbook page. Preferred embodiments further include a magnetic sheet underneath the self-healing mat in conjunction with a steel sliding ruler to help hold the ruler securely in place at a desired position or location.

U.S. Patent Application Publication No. US 2007/0251853: SCRAPBOOK KIT WITH CUSTOMIZABLE PHOTOGRAPHIC IMAGES, by ANDERSON, discloses a scrapbook kit containing customizable photographic images.

U.S. Patent Application Publication No. US 2008/0120535: SYSTEMS AND METHODS FOR MOUNTING MEMORABILIA, by LYNTON, discloses systems and methods for mounting memorabilia in a manner that provides enhanced opportunity for the creative involvement of users. A page layout template is used as a basis for creating a page layout to which design elements are attached. The page layout is a pre-designed template that is configured to be selectively rotated and/or swapped to provide a refreshing theme and/or look, and can be used to more effectively utilize the memorabilia available for mounting and/or storage. The ability to rotate and/or swap the templates enables the ability of a user to reuse pre-established templates to create new looks and presentations. In addition, colors and/or objects can be added to enhance the themes. In one implementation, the templates include two templates per presentation. Each of the templates can be selectively rotated and/or swapped with another template to provide a refreshing theme and/or look, and can be used to more effectively utilize the memorabilia available for mounting and/or storage.

U.S. Patent Application Publication No. US2007/0049477: SECURING ARRANGEMENT OF LOOSE ELEMENTS OF DRAFT SCRAPBOOKING PAGE, by HESTER, discloses an apparatus for securely holding and protecting a layout of elements for a page of a scrapbook includes a portfolio having first and second covers, each cover having a width and height each of which exceeds the width and height of a scrapbooking page; and a first overlay having a width and height each of which exceeds the width and height of a scrapbooking page. The first overlay and the first cover are releasably cohered together, preferably utilizing magnetic forces. A scrapbooking page and loose elements arranged thereof thereby may be secured between the overlay and the cover for safe storage and transport between scrapbooking sessions.

What is needed is a scrapbook kit and/or method for creating a multi-layered visual image with the ability to plan out a scrapbook layout without using or cutting any of the original material during the planning stage, to create new layout designs not heretofore known, and to create known visual displays in a new way. Additionally, there is a need for a system that solves one or more of the problems described herein and/or one or more problems that may come to the attention of one skilled in the art upon becoming familiar with the current specification and appended drawings.

Additionally, what is needed is a method or kit that allows a page layout to be created initially using provided templates having special configurations and interaction to enable a user to design a complete page layout and to modify the page layout without cutting, destroying, gluing, attaching, tearing, modifying, wasting or folding any of the stock material or existing photographs.

Moreover, what are needed in the art of scrap book making are a system and/or method for assisting the user in creating new and unique page layouts. This is especially needed when an artist has "writers block" and needs a jump in getting the creative juices flowing again, but does not take away from the creative aspects of the design process like so many pre designed sticker or boarders do that are already known in the art.

SUMMARY OF THE INVENTION

The present invention has been developed in response to the present state of the art, and in particular, in response to the problems and needs in the art that have not yet been fully solved by currently available template systems. Accordingly, the present invention has been developed to provide templates, specifically to templates for visually planning out and designing layouts for scrapbook pages and a scrapbook kit and method for creating a multi-layered visual image with the ability to plan out a scrapbook layout Implementations of the present invention take place in association with a page layout template system or kit that can be used as a basis for creating a page layout that other embellishments are attached in addition to photographs.

The page layout is created initially using provided transparent, translucent, or opaque templates having special configurations, combinations and interaction to enable a user to design a complete page layout and to modify the page layout without cutting, destroying, gluing, attaching, tearing, modifying, wasting or folding any of the stock material or existing photographs.

While the methods and processes described in the present invention have proven to be particularly useful in the area of scrap booking, photo albums, and journal keeping, those skilled in the are can appreciate that the methods and processes can be used in a variety of different applications and in a variety of areas of manufacture to yield improvements in the characteristics of systems and methods that are used in the arrangement of material in useful ways and creative presentations.

In another embodiment there is a method of creating a visual effect on a scrapbook page, comprising: a) selecting a theme of associated templates (120), the theme selected from a group consisting of: birthdays, holidays, sports, seasons, activities, locations, cultures, plants, animals, historical, religions, beliefs, fantasies, architectural, scientific, geometrics, associations, corporations, memberships, foods, patterns, fictitious, movies, literature, products, services, collections, non-profits, astronomical, aggregations, technologies, entertainments, and artistic; b) selecting at least one scrapbook working page (130); c) placing the selected templates around the selected scrapbook working pages; d) placing at least one of the selected theme templates onto the working pages; e) rearranging the selected theme templates on the working pages; f) removing at least one selected theme template from the working pages; g) placing the removed template from step f) onto a permanent material and cutting out the template shape on the permanent material; h) placing the permanent material cut shape onto the scrapbook working pages where the respective template was located; i) permanently affixing the respective permanent material cut shapes after all of the templates have been removed and respective permanent material cut shapes have been placed on the scrapbook working pages.

In yet another embodiment there may be a kit designed to contain elements used to enable a method of creating a desired visual effect on a scrapbook page, comprising: a) providing a user with a selection of themes of associated templates (120), the themes selected from a group consisting of: birthdays, holidays, sports, seasons, activities, locations, cultures, plants, animals, historical, religions, beliefs, fantasies, architectural, scientific, geometrics, associations, corporations, memberships, foods, patterns, fictitious, movies, literature, products, services, collections, non-profits, astronomical, aggregations, technologies, entertainments, and artistic, wherein each template theme contains boarder templates, accessory templates, and picture templates; a) providing a scrap book kit having: a base surface designed to place at least two scrap book working pages thereon, which are used to place the templates thereon and thus create the desired visual effect; a top flap, coupled to a top edge of the base surface, having at least three pockets thereon for placing the boarder, accessory and picture templates separately therein; a right flap, coupled to a right edge of the base surface, having at least one pocket for placing a sheet of working paper therein; a left flap, coupled to a left edge of the base surface, having a least one pocket for holding pictures selected to be placed on the scrap book working page; selecting and placing from the top flap pocket at least one of the selected theme templates onto the scrap book working page; rearranging at least one of the selected theme templates on the scrap book working page; removing at least one selected theme template from the scrap book working page; removing at least one working paper from the right flap pocket, cutting the working paper using the removed selected theme template that was removed from the scrap book working page and creating a cut working paper shape; placing the cut working paper shape onto the scrapbook working page in an exact place where the respective template was located thereon; and permanently affixing the cut working paper shape on the scrapbook working page.

Additionally, one embodiment may have the kit, wherein the right and left flaps are designed to be placed in a folded position onto the base surface, and the top flap is designed to be placed in a folded position over the right and left flaps and to be affixed to the back side of the base surface to contain all flaps in a single folded unit that contains the scrap book working page and the templates placed thereon while maintaining all templates in place.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
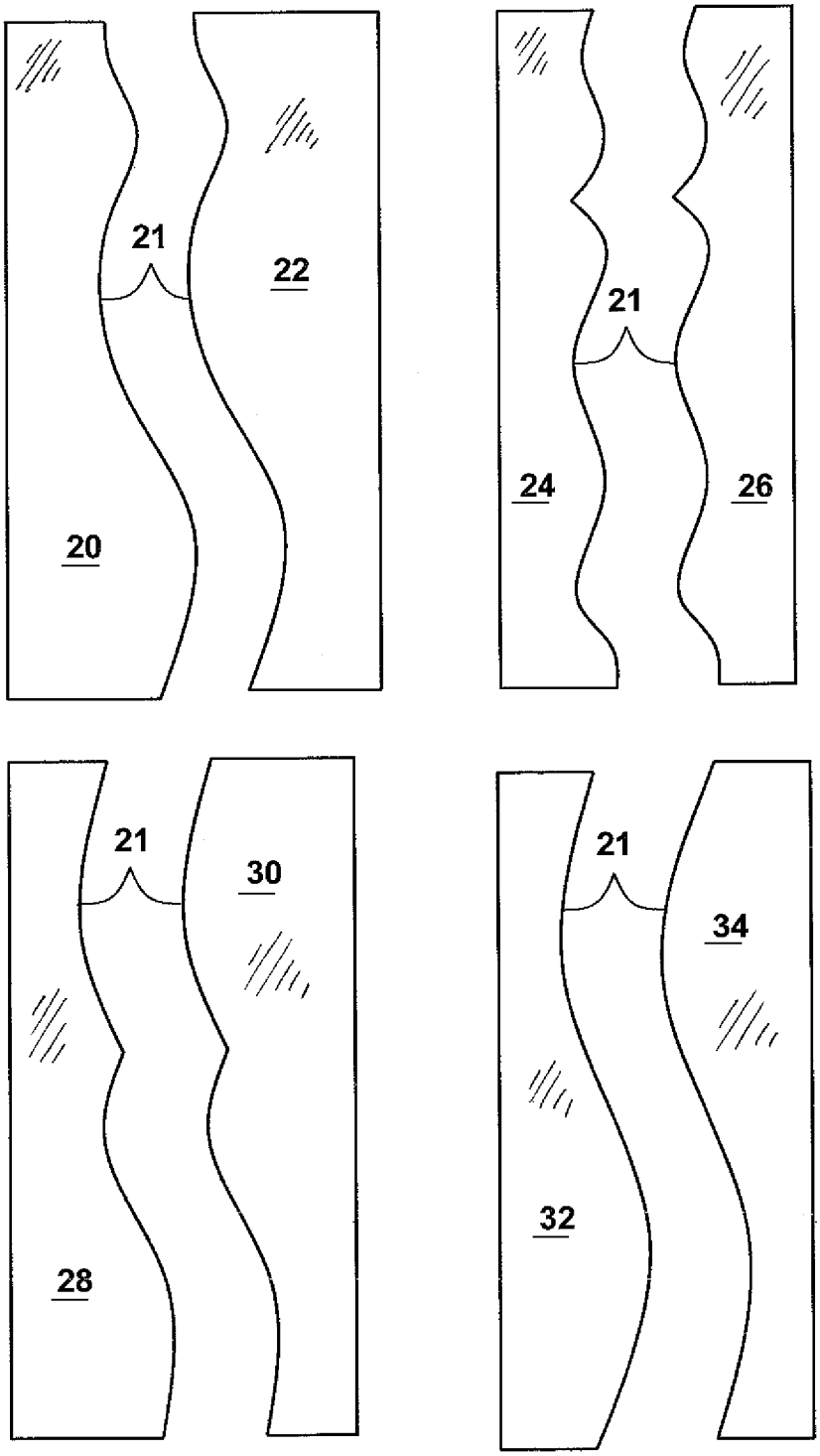
FIG. 1 illustrates various boarder templates related to one embodiment of the illustrated invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

The basis of the present invention is built around the idea of creating a personalized scrap book. Thus, by way of providing definition to the uninitiated in the art of scrap book making, a scrap book is a book with empty pages. The pages are often made of a sturdy material to form the structure, base pages, leafs or supporting substrate in which to place the photographs, embellishments, and associated art work that allows an artist to personalize the works of art.

Reference is made to a "page layout" throughout the specification. This wording is intended to cover multiple pages as well as single pages. Specifically, a designer often designs both the left and right pages of an open book for creating a visual image for the presentation of both pages at once.

Embodiments of the present invention take place in association with a design of a page layout that can be manipulated innumerable times before the actual use of the stock material and actual photographs are used.

Reference is made to stock material which is a reference to a variety of scrap book materials. For example, stock material may mean sheets of colored paper or card board that is intended to be shaped and placed onto the base page of the scrap book. This stock material may be layered on each other in a plurality of ways.

Regarding FIG. 1, there is illustrated various boarder templates related to one embodiment of the illustrated invention. In particular, there are paired templates 20, 22, 24, 26, 28, 30, 32 and 34. It is noted that each pair are mirror images of each other, having a common length, facing working edges 21, and with side and back straight edges. The mirrored working edges 21 are typically formed having curves and geometric shaped portions. Generally, the common length matches a typical scrap book page width as measured from the spine to the outer most line that is parallel to the spine of the book.

Figure 2:
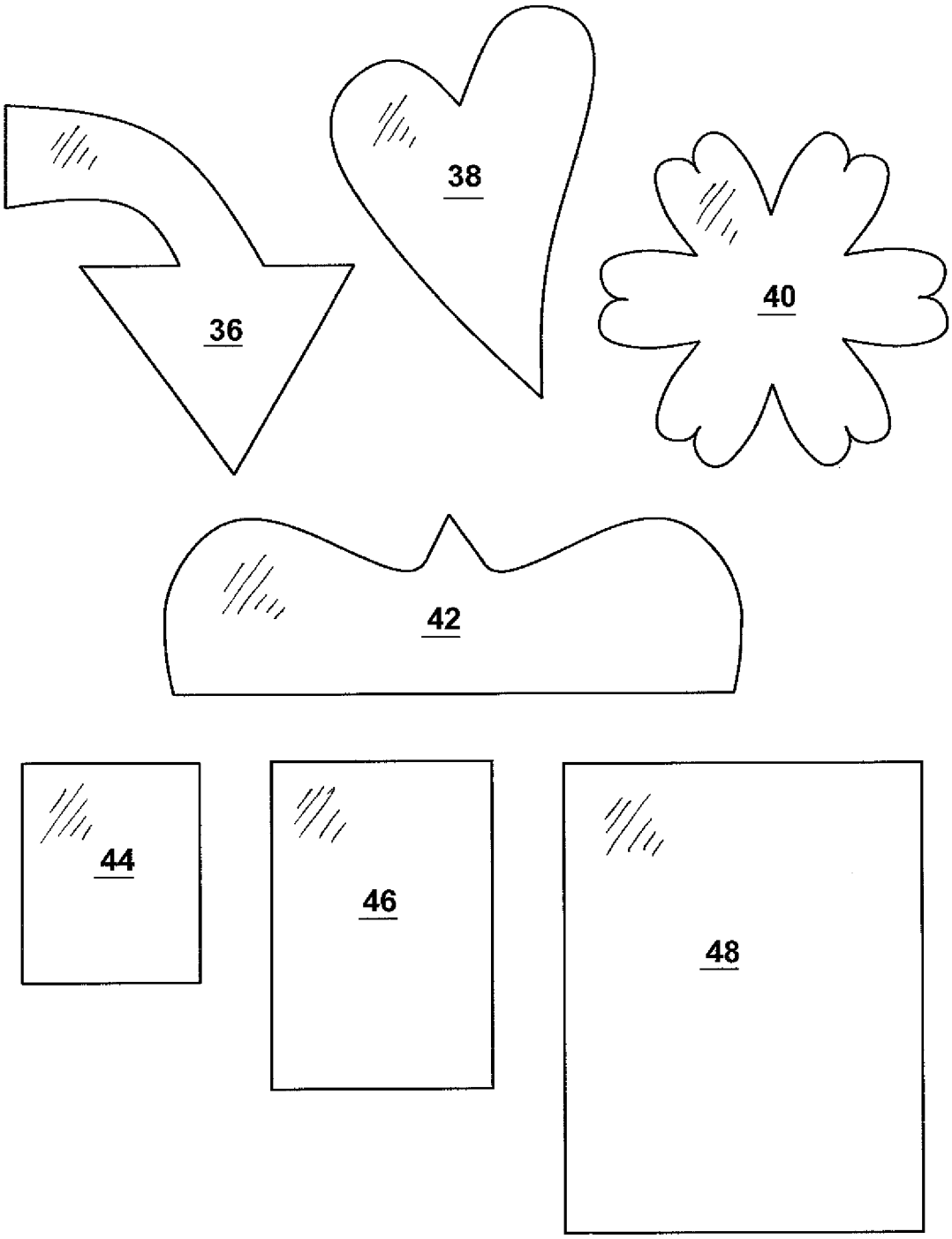
FIG. 2 illustrates various accent and picture templates related to one embodiment of the illustrated invention.

FIG. 2 illustrates various accent and picture templates related to one embodiment of the illustrated invention. Specifically, there are design templates, like a designed arrow 36, hart shape 38, flower shape 40, and bracket shape 42. Additionally, there are rectangle shapes 44, 46, and 48 having different sizes that are used to replicate the size of photographs or pictures.

Figure 3A:
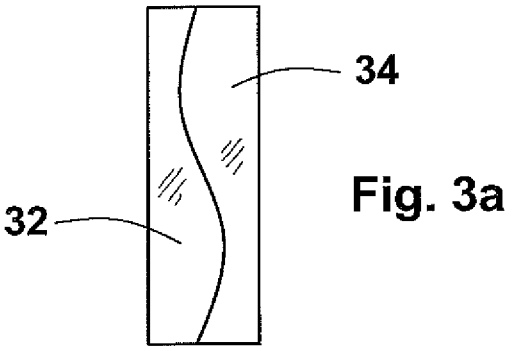
FIGS. 3*a-d* illustrates various forms of one border template related to one embodiment of the illustrated invention.
Figure 3B:
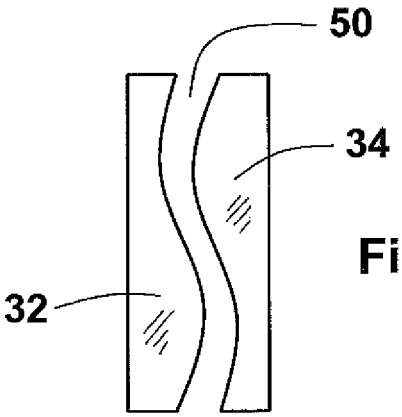
Figure 3C:
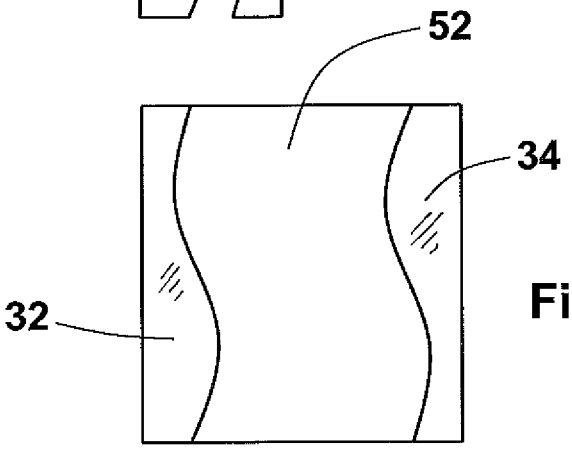
Figure 3D:
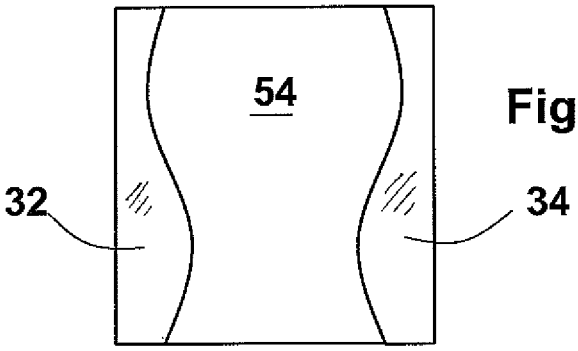

FIGS. 3*a-d* illustrates various forms of one border template related to one embodiment of the illustrated invention. Wherein, FIG. 3*a* shows abutting working edges of the mirrored working edges of one template 32 and 34. FIG. 3*b* shows the concept of forming a relatively small gap 50 located between the two mirrored working edges of mirrored templates 32 and 34. FIG. 3*c* shows the two mirrored working edges placed on a scrapbook page to form a mirrored center gap 52 having opposite edges that run identical to each other. FIG. 3*d* shows where one of the two mirrored templates is vertically inverted to form a different non-mirrored center gap 54. Although attention is drawn to the center gaps 52 and 54, it is also relevant to point out the matching or non-matching boarders created by placing the mirrored templates in the illustrated positions. Thus, it is taught to create different visual images based on just one matching template pair located on just the left and right sides of the page or paper.

Figure 4:
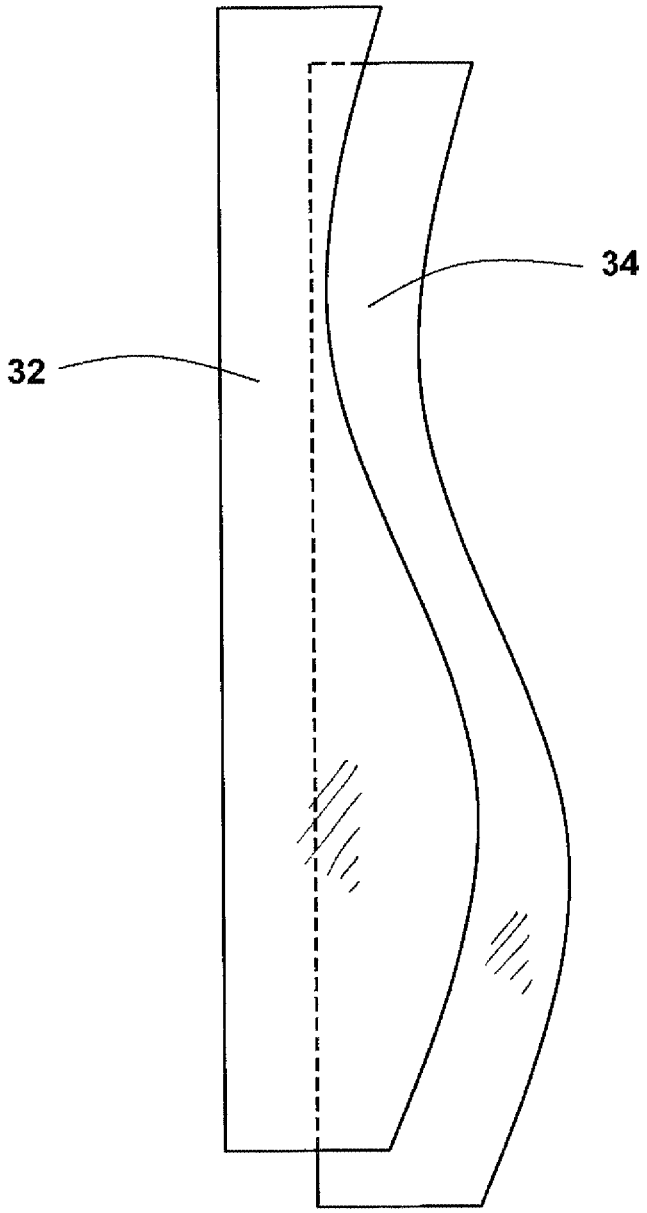
FIG. 4 illustrates two exemplary template.

FIG. 4 illustrates two exemplary overlapping templates 32 and 34 that are made specifically of a material that allows viewing of the lower template 34 through the upper template 32, which is illustrated by way of a dotted line as is conventional. Obvious materials to make the templates out of are all forms of plastic and glass. The opacity of the templates are of infinite variability and are not specified other than the desire to view lower overlapped templates through the top mounted template.

Figure 5:
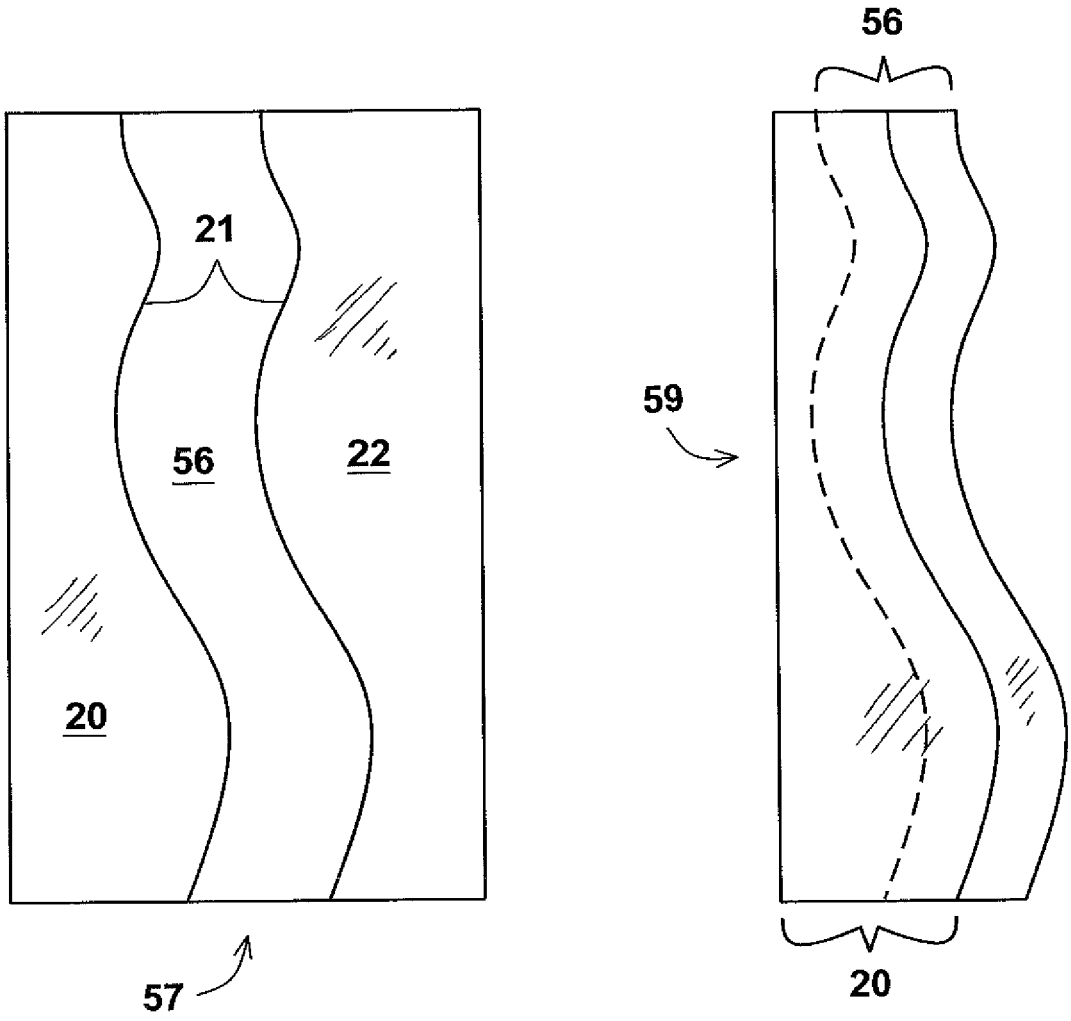
FIG. 5 illustrates two matching templates used to create a visual image.

FIG. 5 illustrates two matching templates used to create certain visual images. In particular, by placing mirrored templates 20 and 22 in parallel relation, and opposing working edges 21, there is formed a gap 55 therebetween over working material or paper 57. A user may then cut along the two working edges to form a parallel strip 56. Thereby, to create a layered visual image 59, the parallel strip 56 width may be adjusted visually by tucking it under template 20. It is noted that this layered image 59 may be placed over the scrapbook page and have the layering width of the strip 56 exposed be adjusted to fit the desired visual effect 59.

Figure 6:
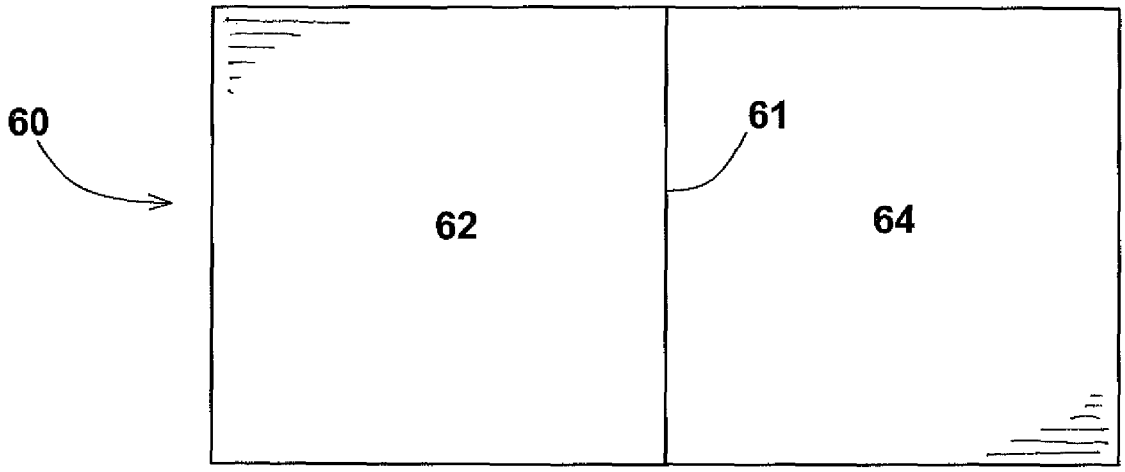
FIG. 6 is an illustration of a starting scrap book blank.

FIG. 6 is an illustration of one embodiment of a starting scrap book 60 with blank left and right pages 62 and 64 separated by a book spine 61 where the two pages meet in the middle of the book. Additionally, the two pages 62 and 64 may not be bound in a book form, but may be unattached during the working process and be placed in a book after the two pages have been completed. In this form, there may be used three holes along the edges of the paper in a known fashion to bind them together, or any other form of attaching pages into a book form.

Figure 7A:
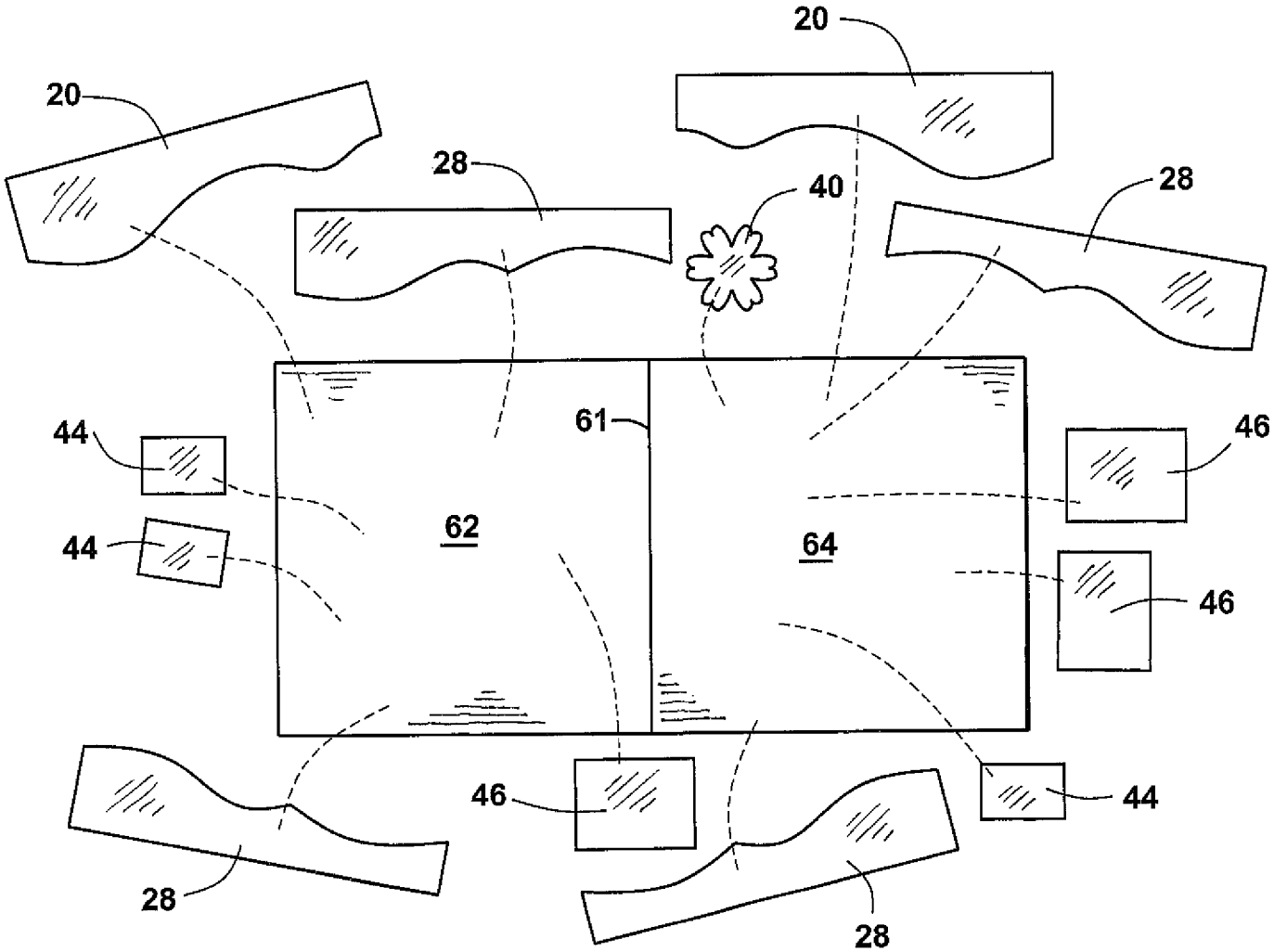
FIG. 7 illustrates populating the blank scrap book with templates.

FIG. 7*a* illustrates populating the blank scrap book pages with templates to create the initial desired visual layered display. Whereby, the dotted lines indicate the placement of the templates onto the two pages.

Figure 7B:
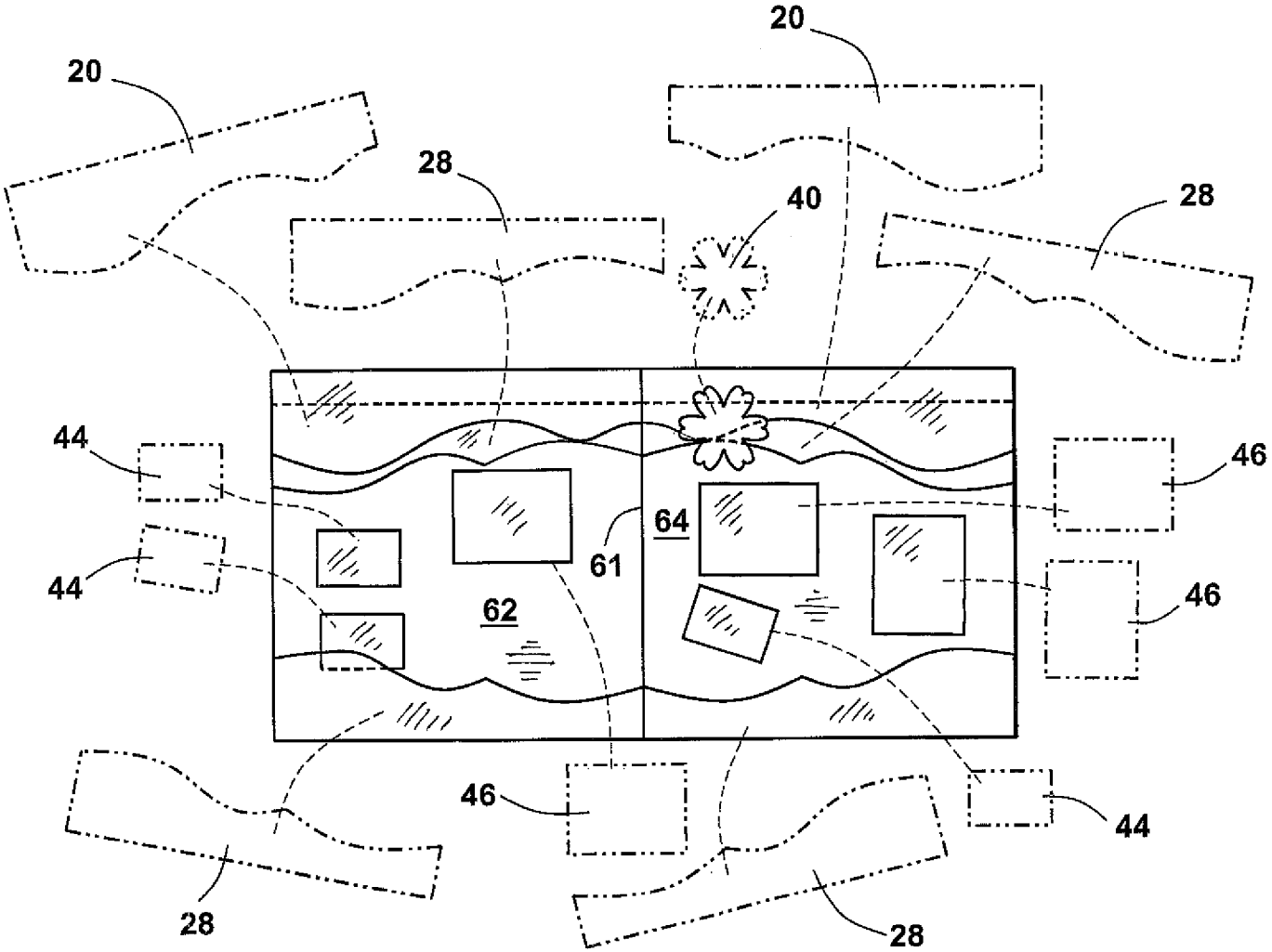

FIG. 7*b* illustrates potential placement of the templates on the two pages. Wherein the dashed templates show where they were, and the solid lines of the templates indicate that the templates have been placed on the pages. Additionally, as shown on the top of the two pages, the boarder templates 28 are illustrated with dashed lines to illustrate that the template 20 is transparent and that it is possible to see template portions that are placed underneath other templates. This transparency is also illustrated with template 44 and 28 located on the lower left side of the illustration.

Figure 8:
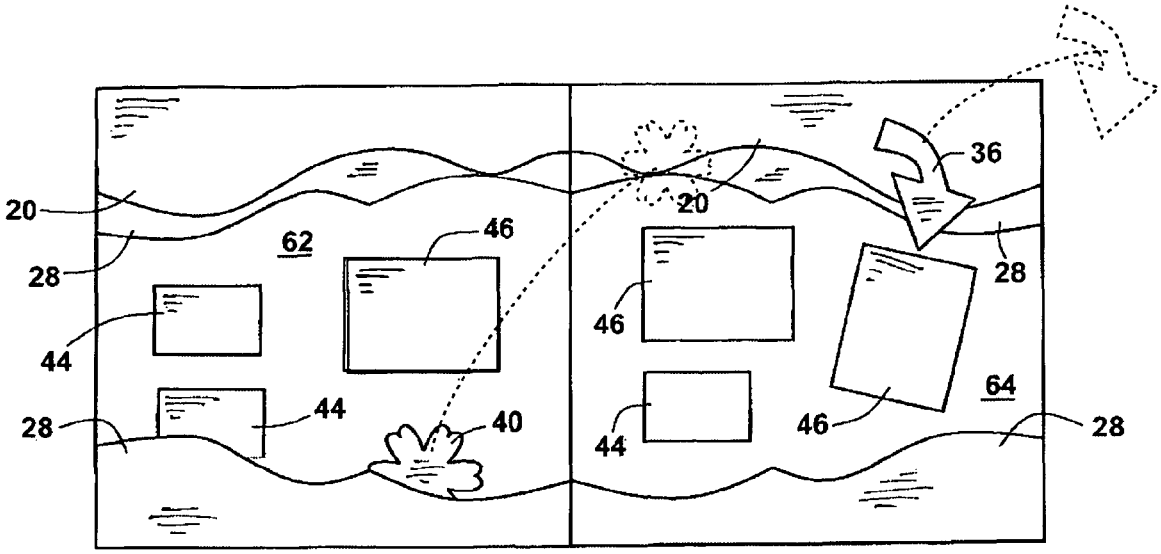
FIG. 8 illustrated the visual manipulation of the templates.

FIG. 8 illustrated the visual manipulation of the templates originally placed on the scrapbook pages as illustrated in FIG. 7. This step is referred to as a visualization adjustment process. Specifically, the flower placement 40 is determined to be removed from the top left on the right page 64 and be moved to the lower right of the left page 62 and placed under the boarder template 28. Additionally, picture sizes 46 and 44 have been repositioned as illustrated. Moreover, arrow template 36 has been added to the top right of the right scrapbook page 64. This adjustment process of adjusting, removing, and adding can be repeated innumerable times without having to cut actual valuable material, like expensive special colored paper, or a rare one-of-a-kind picture.

Figure 9:
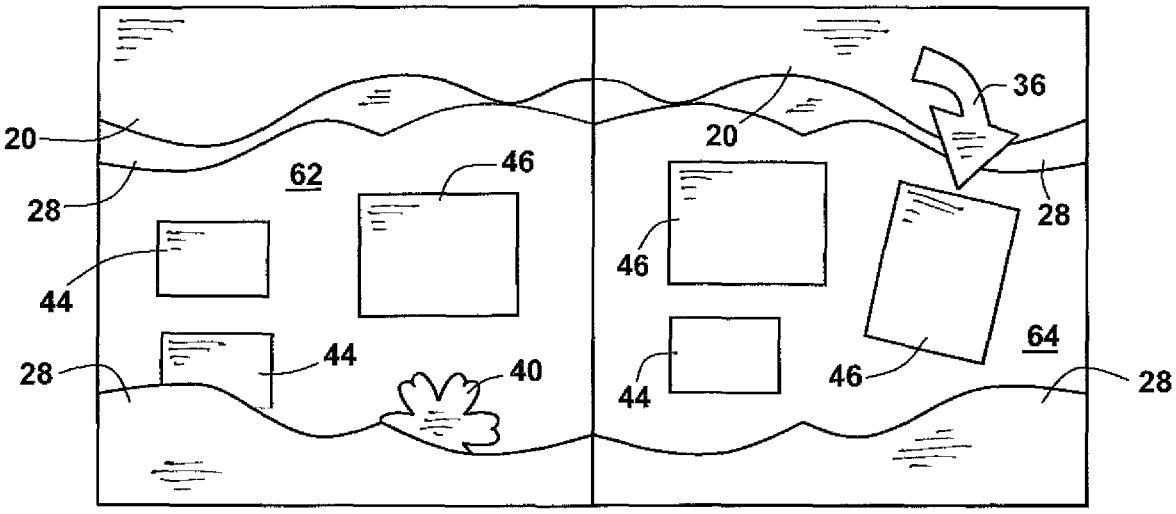
FIG. 9 illustrates the building of the visual display.

FIG. 9 illustrates the building step of the actual resulting visual display. This is where the user removes a single template that is properly located on the page. The removed template is then used to cut the stocked material, like paper, pictures, cloth etc. The now shaped material is placed where the template was once located. This process is repeated for each template until all of the templates are properly relocated on the page. In particular, it is noted that the dashed lines are not illustrated since the actual paper has been placed where the templates were once located. However, none of the actual pictures have been placed at this step.

Figure 10:
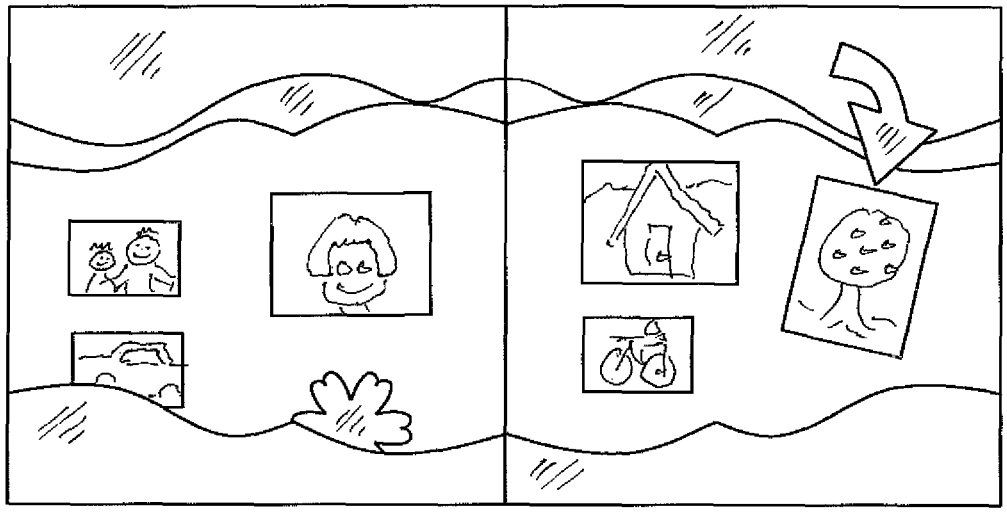
FIG. 10 illustrates a completed visual display.

FIG. 10 illustrates a completed visual display. This is the final step where each shaped material has been properly located and each shaped material is now ready to be permanently affixed to the scrap book pages. In particular, it is illustrated that the pictures have been placed thereon. Next, all of the pieces are ready to be permanently affixed to the base pages. Known affixing processes are used herein, like gluing, taping, fastening etc. It is noted that all of the items placed on the page have no dotted lines, since there are no transparent templates remaining on the page(s).

Figure 11:
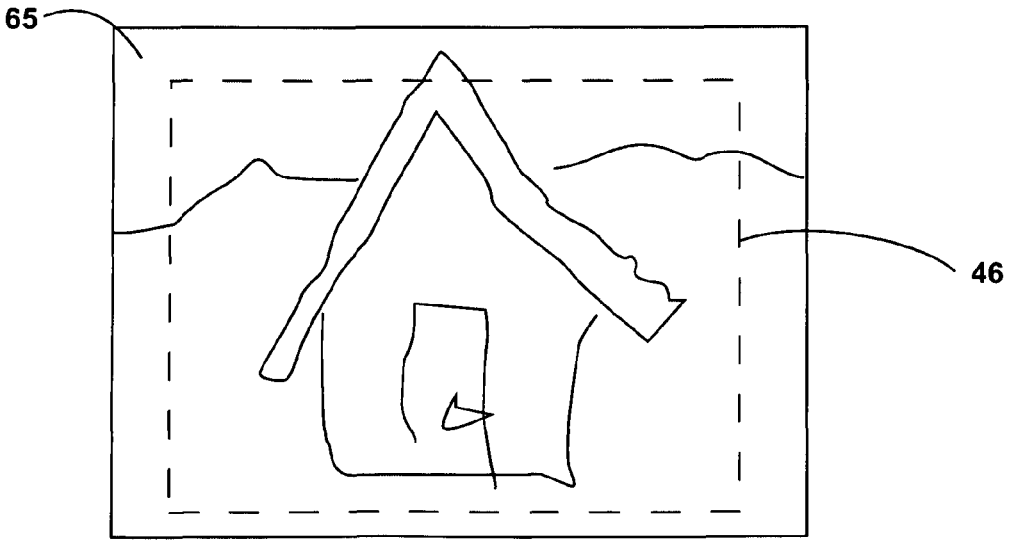
FIG. 11 illustrates a visual display cropping technique.

FIG. 11 illustrates a visual display cropping technique for pictures. Specifically, it is already known that the proper selected template 46. The template 46 is positioned over the picture 65 and the template can be positioned to get the best shot. Whereby, the picture 65 can be cut to the template size with confidence that the picture does not have to be re-cut to fit the selected scrap book page. This is picture cutting step is particularly more difficult than it appears. If there were no actual template used, it is near impossible to know how to cut the picture to fit the scrapbook page and get the maximum viewing cut from the one-of-a-kind picture.

Figure 12:
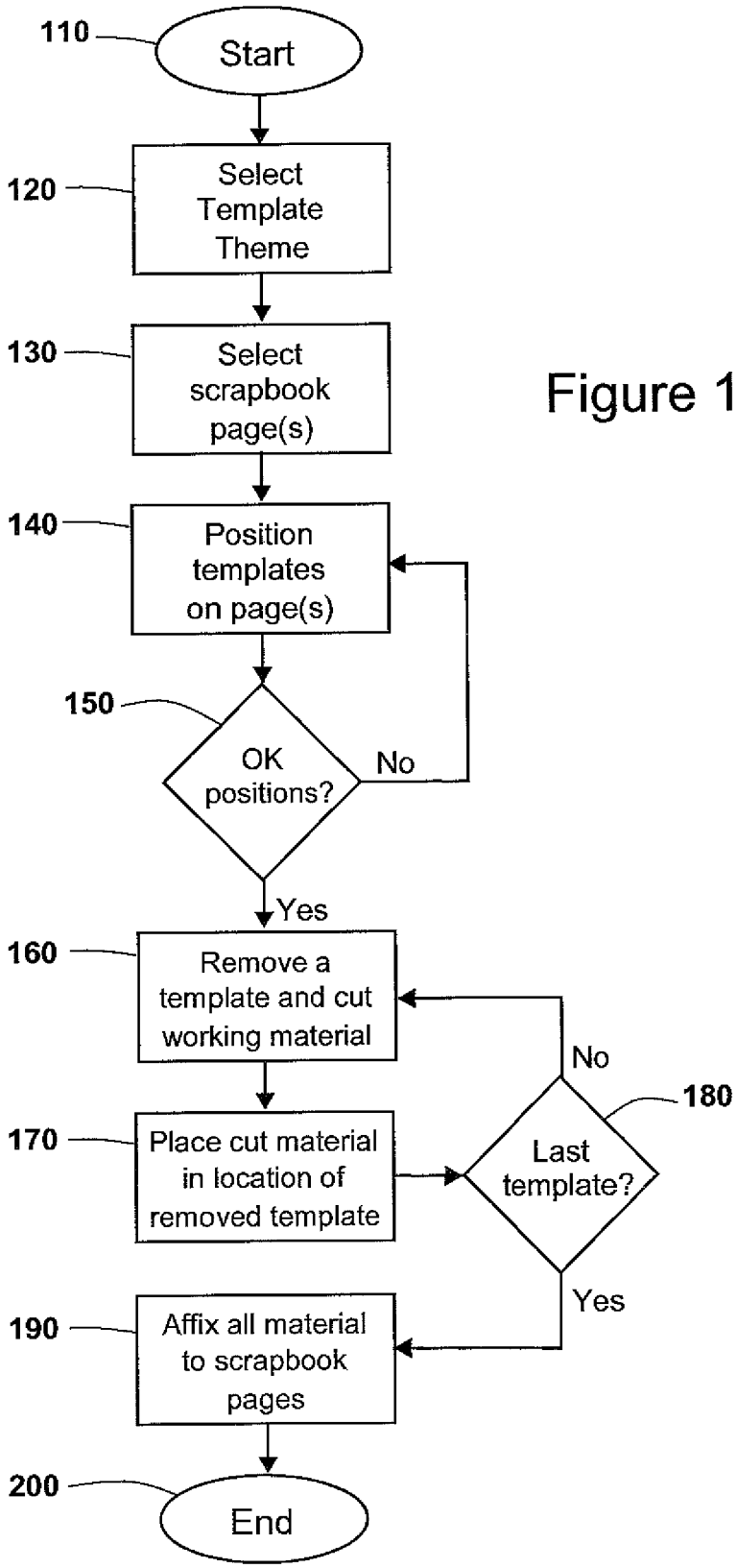
FIG. 12 illustrates a flow chart of the illustrated embodiment operation.

FIG. 12 illustrates a flow chart 100 of one embodiment of the illustrated embodiments of the inventive process. In particular, the process starts 110 with the step of selecting a template theme 120 and the associated templates matching that theme are collected to create the visual effect for the scrapbook. This may typically involve selecting any number of themes, like birthdays, holidays (Easter, Thanksgiving etc.), sports (football, volleyball, scuba diving etc.), seasons (spring, summer etc.), activities (camping, fishing etc.), locations (Disney, Yellowstone, New York, Vermont, Africa etc.), or any other known theme that matches pictures that are taken by users.

After the templates matching the selected theme have been collected, the proper pages in the scrap book are selected 130. Typically, this would include at least a single page or as many as an entire scrap book in the case of having a whole collection of pictures to commemorate an event like a two week long trip throughout Europe.

Next, the templates are positioned 140 on the selected starting page(s) one at a time. Whereby, it is determined if the visual image is acceptable 150. If the image is not acceptable the positioning of templates continues 140.

If the right positioning is acceptable for the entire page(s) then the cutting of the valuable material begins 160. Specifically, each template is removed one at a time and used as a pattern to place over the respective material. The template is then outlined on the material. The template is removed and the lines are then cut by a scissors to create the pre arranged material shape. The material shape is then placed in the location of the removed template 170. If this is not the last template 180 then you continue to the removing and cutting operations 160 and 170. When you have no further templates 180, the user then begins the permanently affixing of all materials to the page(s) of the scrap book 190. When the last shaped material has been permanently attached, the process is ended 200.

FIGS. 13-19 illustrates a kit for implementing the template system herein described in FIGS. 1-12. Now that the basic operation of the new and unique method for assembling scrap book and other designs has been described, the following discussion will detail how the complete kit operates in cooperation therewith.

Figure 13:
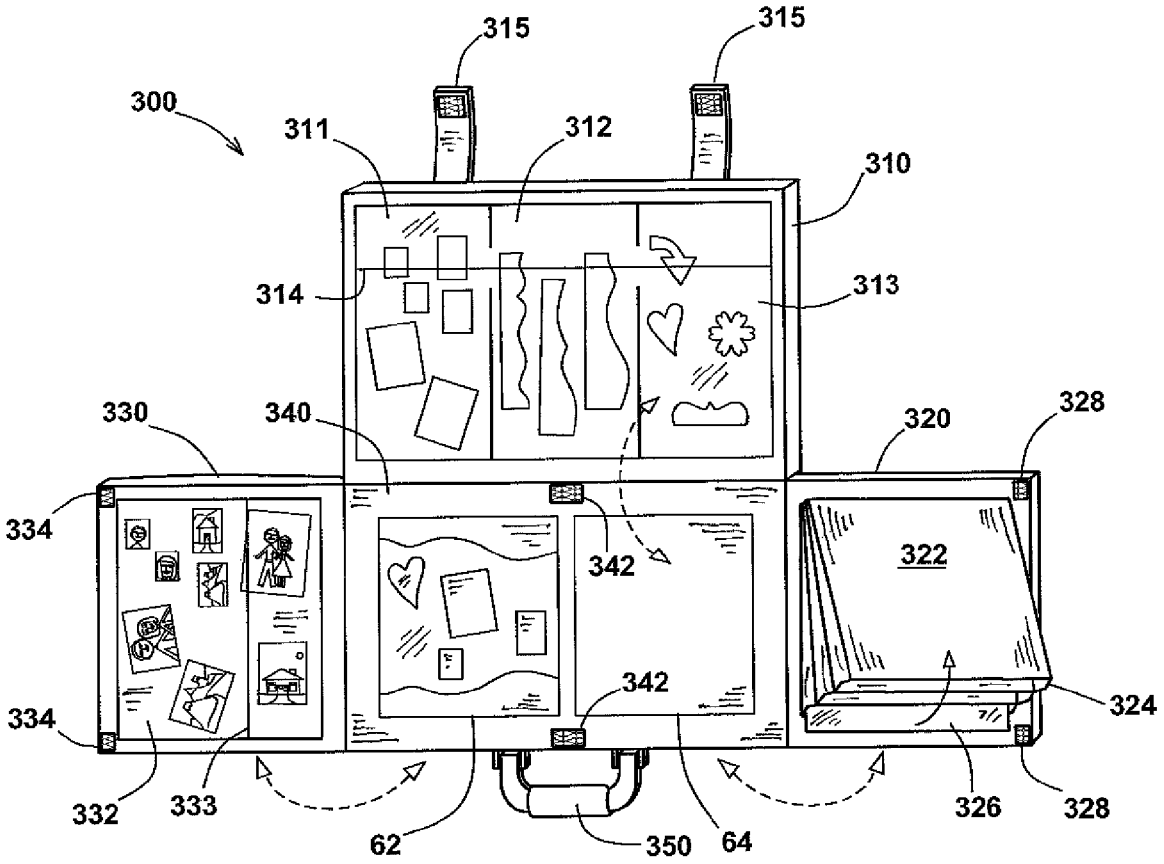
FIG. 13 illustrates a schematic of a top view of the kit.
Figure 14:
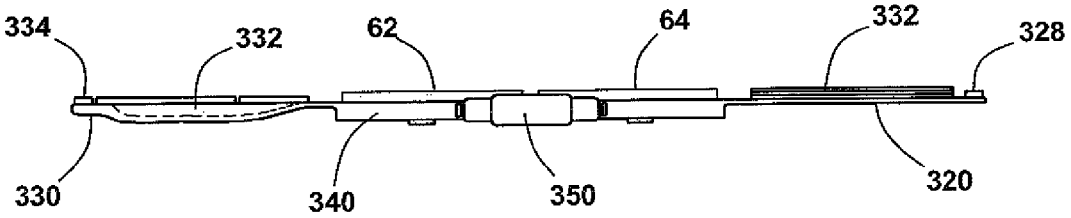
FIG. 14 illustrates a schematic of a top view of the kit.
Figure 15:
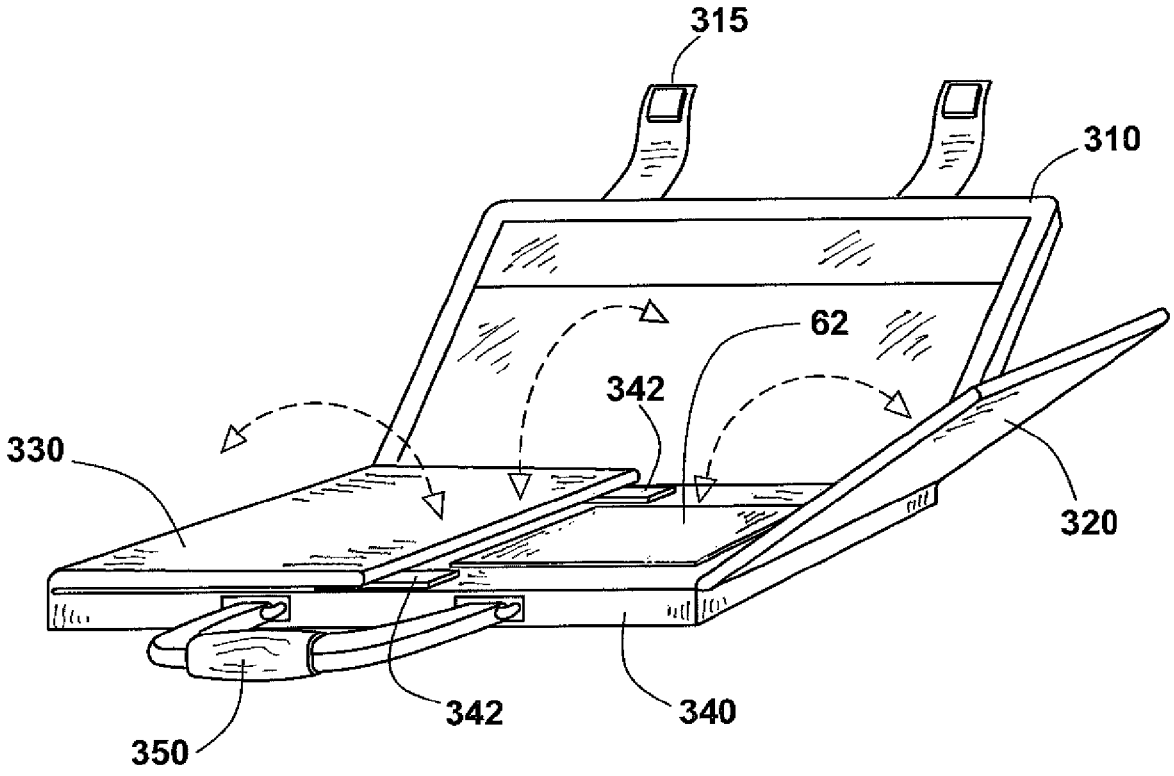
FIG. 15 illustrates a view of a method and design for folding the kit in a closed position.
Figure 17:
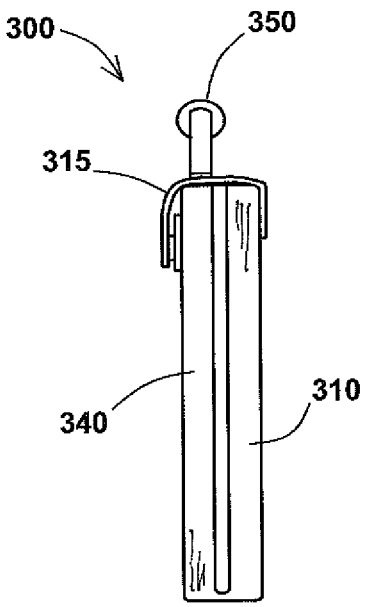
FIG. 17 illustrates a view of a method and design for folding the kit in a closed position.
Figure 16:
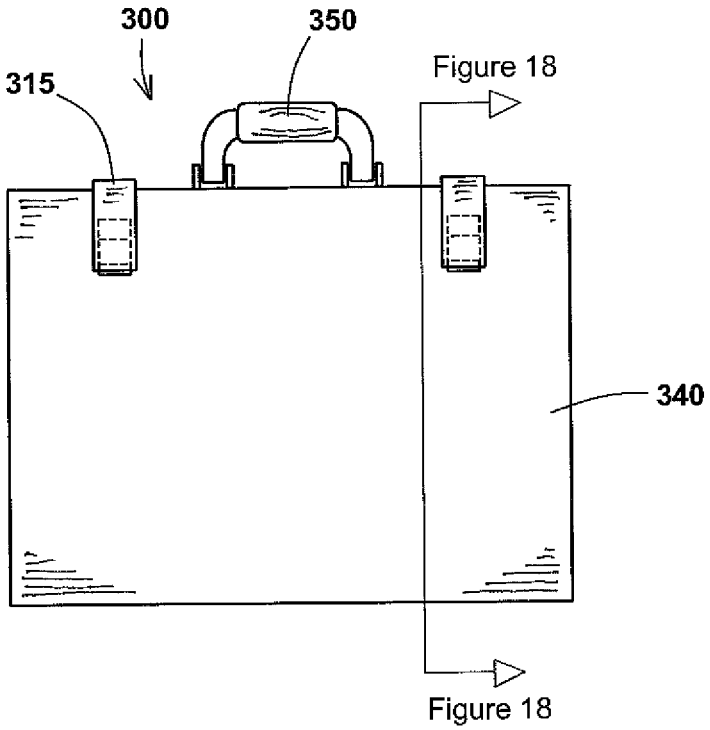
FIG. 16 illustrates a view of a method and design for folding the kit in a closed position.
Figure 19:
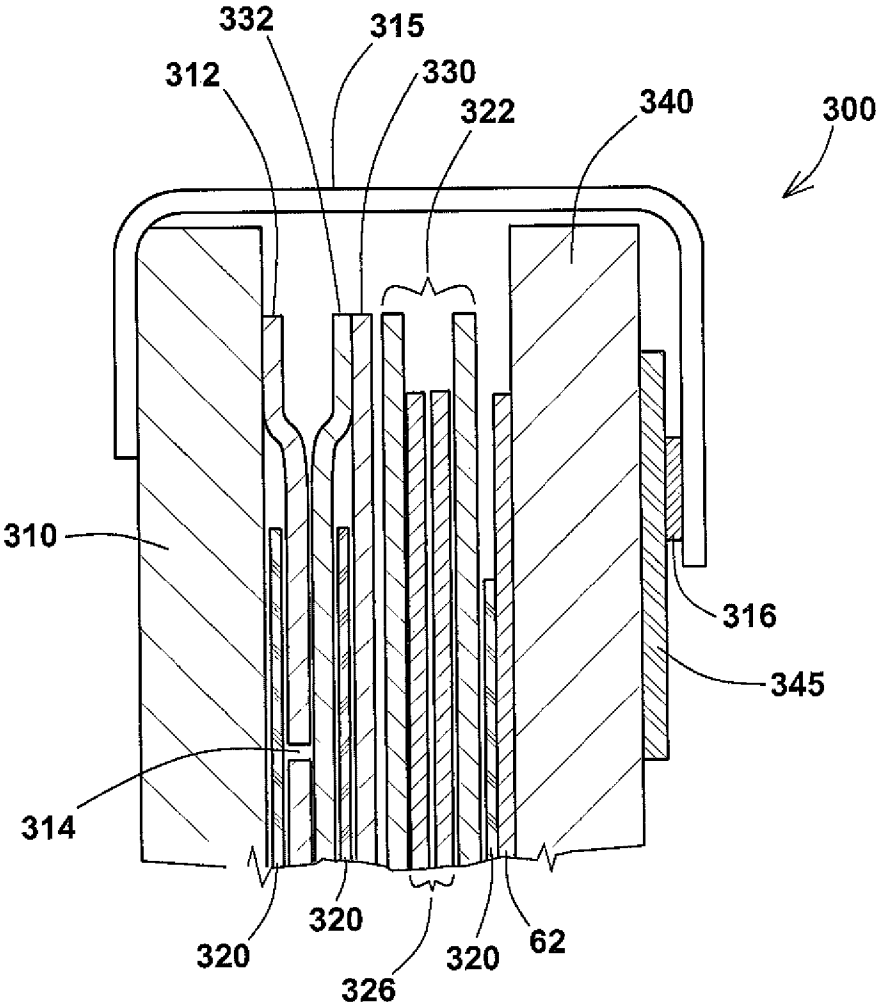
FIG. 19 illustrates an enlarged side view of a method and design for folding the kit in a closed position.
Figure 18:
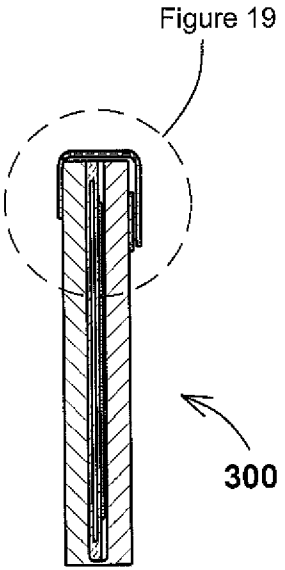
FIG. 18 illustrates a side view of a method and design for folding the kit in a closed position.

Referring specifically to FIGS. 13 and 14, there is illustrated a schematic of a top view of the kit 300. The kit 300 includes a top flap 310, a right flap 320, left flap 330, and a base surface 340. There is shown one embodiment of a handle 350, and attachable tabs 315 to secure the kit when fully closed. The top flap 310 includes at least one flexible storage section 311, and may have more 312 and 313, each having an opening 314 to enable templates to be stored therein. Specifically, picture templates may be stored in a first storage section 311, boarder templates may be stored in a second section 312, and accessory templates may be stored in a third storage section 313 as illustrated in the figure.

Referring to the right flap 320, there is mounted thereto a fold out multi paper storage section 322 that has multiple pockets 324 for placing the valuable stock paper 326 therein the different pockets. In each corner is located an attachment device 328, like a hook and eye device, as illustrated.

Referring to the left flap 330, there is mounted thereon a translucent storage section 332 with a slot 333 for placing desired pictures to be mounted on the scrap book pages. Also, there is mounted in the corners an attachment device 334, like a hook and eye device, as illustrated.

Referring to the base surface 340, there is placed thereon two sheets of scrap book pages 62 and 64 as illustrated. Additionally, there is mounted in a central edge position two attachment devices 342, like a hook and eye device, as illustrated, that are designed to be coupled to the matching attachment devices 328 and 334 upon closing the kit 300.

Referring to FIGS. 15-19, there is illustrated the method and design for folding the kit 300 in a closed position. First the right and left flaps 320 and 330 are folded inward so that the attachment devices 334, 328 and 342 all align in a known fashion to close and hold the two flaps close to the base surface 340. Thereby, the top flap 310 is rotated to close over the left and right side flaps. The retaining straps 315 are then attached, via hook and eye attachment devices 316 to the matching hook and eye attachment devices 345 located on the back side of the base surface 340.

It is noted that upon folding of the overall kit 300, all scrap book pages, templates and cut material placed on the scrap book pages will be held in place and not allowed to move or be misaligned during transportation.

Additionally, the kit 300 is integral with the operation of the assembly process as described in detail regarding FIGS. 1-12. Specifically, since all of the storage compartments of the kit are transparent, a user can see the templates to be placed on the scrap book pages. The three sections of storage on the top flap 310 uniquely fit the number of parts for the templates, namely the boarders, accents, and picture templates. Additionally, the left flap 330 is uniquely positioned to contain in a clear container section 332 to allow the user to see the pictures that the templates are being placed around. Finally, the right flap 320 is designed to hold all the desired paper that is to be used to replace the templates once the desired visual effect has been created on the scrap book pages. Whereby, the scrap paper left after cutting to match the templates can be put back into the storage compartments 322.

It is noted that the time needed to create a single two page scrap book section may take several hours. The user may only have a portion of that time and need to pack away the whole kit before completing the project. With the folding design of the kit, the work in progress does not have to be disturbed, or have a threat of being jostled or dumped off of the pages, requiring the user to start all over again. The templates are used to assist the user to come up with new and unique designs for the selected pictures. All of these components uniquely fit into the illustrated kit design.

Accordingly, the present invention has been developed to provide templates, specifically to templates for visually planning out and designing layouts for scrapbook pages and a scrapbook kit and method for creating a multi-layered visual image with the ability to plan out a scrapbook layout Implementations of the present invention take place in association with a page layout template system or kit that can be used as a basis for creating a page layout that other embellishments are attached in addition to photographs.

The page layout is created initially using provided transparent, translucent, or opaque templates having special configurations, combinations and interaction to enable a user to design a complete page layout and to modify the page layout without cutting, destroying, gluing, attaching, tearing, modifying, wasting or folding any of the stock material or existing photographs.

While the methods and processes described in the present invention have proven to be particularly useful in the area of scrap booking, photo albums, and journal keeping, those skilled in the are can appreciate that the methods and processes can be used in a variety of different applications and in a variety of areas of manufacture to yield improvements in the characteristics of systems and methods that are used in the arrangement of material in useful ways and creative presentations.

In another embodiment there is a method of creating a visual effect on a scrapbook page, comprising: a) selecting a theme of associated templates (120), the theme selected from a group consisting of: birthdays, holidays, sports, seasons, activities, locations, cultures, plants, animals, historical, religions, beliefs, fantasies, architectural, scientific, geometrics, associations, corporations, memberships, foods, patterns, fictitious, movies, literature, products, services, collections, non-profits, astronomical, aggregations, technologies, entertainments, and artistic; b) selecting at least one scrapbook working page (130); c) placing the selected templates around the selected scrapbook working pages; d) placing at least one of the selected theme templates onto the working pages; e) rearranging the selected theme templates on the working pages; f) removing at least one selected theme template from the working pages; g) placing the removed template from step f) onto a permanent material and cutting out the template shape on the permanent material; h) placing the permanent material cut shape onto the scrapbook working pages where the respective template was located; i) permanently affixing the respective permanent material cut shapes after all of the templates have been removed and respective permanent material cut shapes have been placed on the scrapbook working pages.

In yet another embodiment there may be a kit designed to contain elements used to enable a method of creating a desired visual effect on a scrapbook page, comprising: a) providing a user with a selection of themes of associated templates (120), the themes selected from a group consisting of: birthdays, holidays, sports, seasons, activities, locations, cultures, plants, animals, historical, religions, beliefs, fantasies, architectural, scientific, geometrics, associations, corporations, memberships, foods, patterns, fictitious, movies, literature, products, services, collections, non-profits, astronomical, aggregations, technologies, entertainments, and artistic, wherein each template theme contains boarder templates, accessory templates, and picture templates; a) providing a scrap book kit having: a base surface designed to place at least two scrap book working pages thereon, which are used to place the templates thereon and thus create the desired visual effect; a top flap, coupled to a top edge of the base surface, having at least three pockets thereon for placing the boarder, accessory and picture templates separately therein; a right flap, coupled to a right edge of the base surface, having at least one pocket for placing a sheet of working paper therein; a left flap, coupled to a left edge of the base surface, having a least one pocket for holding pictures selected to be placed on the scrap book working page; selecting and placing from the top flap pocket at least one of the selected theme templates onto the scrap book working page; rearranging at least one of the selected theme templates on the scrap book working page; removing at least one selected theme template from the scrap book working page; removing at least one working paper from the right flap pocket, cutting the working paper using the removed selected theme template that was removed from the scrap book working page and creating a cut working paper shape; placing the cut working paper shape onto the scrapbook working page in an exact place where the respective template was located thereon; and permanently affixing the cut working paper shape on the scrapbook working page.

Additionally, one embodiment may have the kit, wherein the right and left flaps are designed to be placed in a folded position onto the base surface, and the top flap is designed to be placed in a folded position over the right and left flaps and to be affixed to the back side of the base surface to contain all flaps in a single folded unit that contains the scrap book working page and the templates placed thereon while maintaining all templates in place.

There are many advantages that are realized by the practice of the illustrated embodiments of the invention that are not taught by the known prior art. One skilled in the art will realize the savings from not having to destroy valuable stock material in trying to cut and then toss out the cut material because it does not fit or create the desired visual effects for the selected pages.

Another advantage is that there is a particular known effect called "writers block" that affects not only writers, but also scrapbook artists. The "Artists Block" occurs when the artist has been working on a project for many hours and then simply runs out of new ideas of their own. The effects can be that the artist just sits there looking at the blank scrapbook page with all these pictures and piles of stock material and simple does not know what to do next. There are simply no more creative juices left. This is where the techniques described in the specification are instrumental to assist the artist to continue the work. This is where half the work of creativity is taken care of. There are provided to the artist a group of shapes that can be used to pre-plan the layout of the page(s) without having to cut a single valuable stock material or one-of-a-kind picture.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the reference has been made to scrap books throughout the specification, one skilled in the art will realize after reading the specification that there are other uses for the illustrated embodiments of the invention. Specifically, the same visual creating techniques are usable on creating multi-layers cards that are given to others. The cards typically used are for birthdays; get well, anniversaries, holidays, wedding announcements, etc.

Additionally, although the figures illustrate only a few select templates, one skilled in the art will realize that there are an infinite number of templates that can be used. For example, as previously mentioned, there are all sorts of theme based templates, like foot ball etc. There are also all sorts of geometric type templates too numerous to mention or list. By way of example only, there may be rounded boarders, angular boarders, star shapes, musical instruments, castles, cartoons, wave boarders, etc.

It is also envisioned that the illustrated templates may be placed in any location on the scrapbook pages and not just where the appended drawings are illustrating.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is desired to be claimed as Letters Patent under the United States Constitution, Article 1, section 8, clause 8, "To promote the progress of the science and useful arts, by securing for limited times to authors and inventors the exclusive right to their respective writings and discoveries", is set forth herein after:

1. A method of creating a visual effect on a scrapbook page, comprising:

a) selecting a theme of associated templates, the theme selected from a group consisting of: birthdays, holidays, sports, seasons, activities, locations, cultures, plants, animals, historical, religions, beliefs, fantasies, architectural, scientific, geometries, associations, corporations, memberships, foods, patterns, fictitious, movies, literature, products, services, collections, non-profits, astronomical, aggregations, technologies, entertainments, and artistic;

b) selecting at least one scrapbook working page;

c) placing at least one of the selected theme templates around the selected scrapbook working pages;

d) placing at least one of the selected theme templates onto the working pages;

e) rearranging the selected theme templates on the working pages;

f) removing at least one selected theme template from the working pages;

g) placing the removed template from step f) onto a permanent material and cutting out the template shape on the permanent material;

h) placing the permanent material cut shape onto the scrapbook working pages where the respective template was located; and i) permanently affixing the respective permanent material cut shapes after all of the templates have been removed and respective permanent material cut shapes have been placed on the scrapbook working pages, using a scrap book kit comprising a base surface and right and left flaps, wherein the right and left flaps are designed to be placed in a folded position onto the base surface, and the top flap is designed to be placed in a folded position over the right and left flaps and to be affixed to the back side of the base surface to contain all flaps in a single folded unit that contains the scrap book working page and the templates placed thereon while maintaining all templates in place.

* * * * *